US005705759A

United States Patent [19]

DeVivo

[11] Patent Number: 5,705,759

[45] Date of Patent: Jan. 6, 1998

[54] TWO-TIERED MUSIC BOX WITH REVOLVING FIGURINES

[75] Inventor: Douglas E. DeVivo, Taipei, Taiwan

[73] Assignee: Mercuries & Associates (USA), Ltd., Bethlehem, Pa.

[21] Appl. No.: 802,823

[22] Filed: Feb. 19, 1997

Related U.S. Application Data

[63] Continuation-in-part of Ser. No. 376,036, Jan. 20, 1995, abandoned.

[51] Int. Cl.[6] ..... G10F 1/06

[52] U.S. Cl. ..... 84/95.2; 446/298; 17/20; 40/410; 40/505; 40/503

[58] Field of Search ..... 84/94.1, 94.2, 84/95.1, 95.2; 40/455, 457, 409, 410, 493, 503, 504, 505; 446/297, 298, 265, 303; 17/24

[56] References Cited

U.S. PATENT DOCUMENTS

| | | | |
|---|---|---|---|
| 5,092,065 | 3/1992 | Teng | 40/410 |
| 5,110,636 | 5/1992 | Hou | 84/95.1 |

OTHER PUBLICATIONS

The San Fransisco Music Box Company Catalog, Nov. 2, 1991, pp. 32 and 34.

*Primary Examiner*—Cassandra C. Spyrou

*Attorney, Agent, or Firm*—Collier, Shannon, Rill & Scott, PLLC

[57] ABSTRACT

A decorative display device comprising figurines arranged in tiered first and second scenes, one scene being placed above the other. Each of the upper and lower tier scenes is coupled to a wind-up drive and music box mechanism and when rotated appears to be in synchronization with the music. The rotatable and music synchronized scenes are more noticeable and aesthetically pleasing and, thus, provide a more interesting display. The upper and lower tier scenes may rotate simultaneously, at different speeds (but in the same direction), in opposite directions, in opposite directions at different speeds, or one scene may rotate while the other scene remains stationary.

18 Claims, 5 Drawing Sheets

TWO-TIERED MUSIC BOX WITH REVOLVING FIGURINES

CROSS-REFERENCE TO RELATED APPLICATION

This application is a continuation-in-part of U.S. patent application Ser. No. 08/376,036, filed Jan. 20, 1995, and now abandoned.

FIELD OF THE INVENTION

The present invention relates to devices for displaying ornamental objects and, more particularly, to decorative devices for displaying objects arranged into a plurality of scenes, some of which may be immersed in liquid.

BACKGROUND OF THE INVENTION

Decorative devices for displaying scenes such as contemplated by the present invention, some of which may be immersed in fluid, are well known and are described, for example, in U.S. Pat. No. 4,490,931 (Fleemin), U.S. Pat. No. 5,088,218 (Liu), U.S. Pat. No. 5,110,636 (Hou), U.S. Pat. No. 5,179,796 (Gephart, Jr.), and U.S. Pat. No. 5,286,535 (Hou), all of which are incorporated herein by reference.

The Hou patents disclose a display device wherein decorative objects are immersed in a liquid-filled housing which is rotatably mounted on a base and driven by a wind-up music box mechanism. The decorative display device of the Hou patents, while serving its intended purpose, is limited to a single scene. The present invention describes improvements to such a device so that a more noticeable and pleasing display may be made available to enhance the excitement of the aesthetic interest conjured up by such decorative display devices.

It is, therefore, an object of the present invention to provide decorative display devices having revolving scenes to enhance their aesthetic effect.

It is also an object of the present invention to provide decorative display devices having scenes that are comprised of figurines that are merged together in such a manner so as to enhance the aesthetic effect of the scene.

It is a further object of the present invention to provide decorative display devices having first and second revolving scenes located in a tier arrangement so that both scenes are captured in the field-of-view of an individual so as to enhance both their noticeability and aesthetic effect.

Further still, it is an object of the present invention to provide decorative display devices having counter-revolving scenes so as to further enhance their noticeability.

Yet further, it is another object of the present invention to provide for revolving scenes having complementary and/or contrasting backgrounds so as to not only further enhance their noticeability but to also increase their aesthetic effect.

In addition, it is an object of the present invention to provide for decorative display devices that are portable and capable of being carried or moved about and operated without the need of an external power source, such as household power.

Moreover, it is an object of the present invention to provide decorative display devices having scenes that are revolved in apparent synchronization with a tune or melody that complements the aesthetic effect being depicted by the revolving scenes.

Further objects and features of the present invention will become evident hereinafter.

SUMMARY OF THE INVENTION

The present invention is directed to decorative display devices comprising figurines arranged into first and second scenes, one scene being placed above the other in a tier. Each of the scenes, either the upper or the lower scene, may be coupled to a music box mechanism and rotatable so that each scene appears to be in synchronization with the music produced by the music box.

The decorative display device comprises first and second scenes, means for positioning each scene relative to the other, a wind-up drive means having a rotatable output shaft, and means for magnetically coupling either or both of the scenes to the drive means. The first scene has a base and comprises figurines contained within a transparent enclosure. The second scene has a base and also comprises figurines contained within a transparent enclosure. The means for locating each scene relative to the other positions the base of the first scene in substantially the same horizontal orientation as the base of the second scene, but at a predetermined vertical distance therefrom.

Each of the means for coupling the drive means to either the first or second scene may be incorporated in the apparatus. When utilized, the means for magnetically coupling engages the base of the first scene with the output shaft of the drive means so that the first scene may be engaged to rotate in a first direction. The means for mechanically coupling engages the base of the second scene with the output shaft of the drive means so that the second scene may be engaged to rotate in the first direction or in a second direction.

The decorative display device has various embodiments that cause the scenes to revolve simultaneously, at different speeds (but in the same direction), in opposite directions, or in opposite directions at different speeds.

BRIEF DESCRIPTION Of THE DRAWINGS

For the purpose of illustrating the invention, there is shown in the drawings forms which are presently preferred; it being understood, however, that the invention is not limited to the precise arrangements and instrumentalities shown.

DETAILED DESCRIPTION OF THE PREFERRED EMBODIMENTS

The following detailed description is of the best presently contemplated mode of carrying out the invention. The description is not intended in a limiting sense, and is made solely for the purpose of illustrating the general principles of the invention. The various features and advantages of the present invention may be more readily understood with reference to the following detailed description taken in conjunction with the accompanying drawings.

Figure 1:
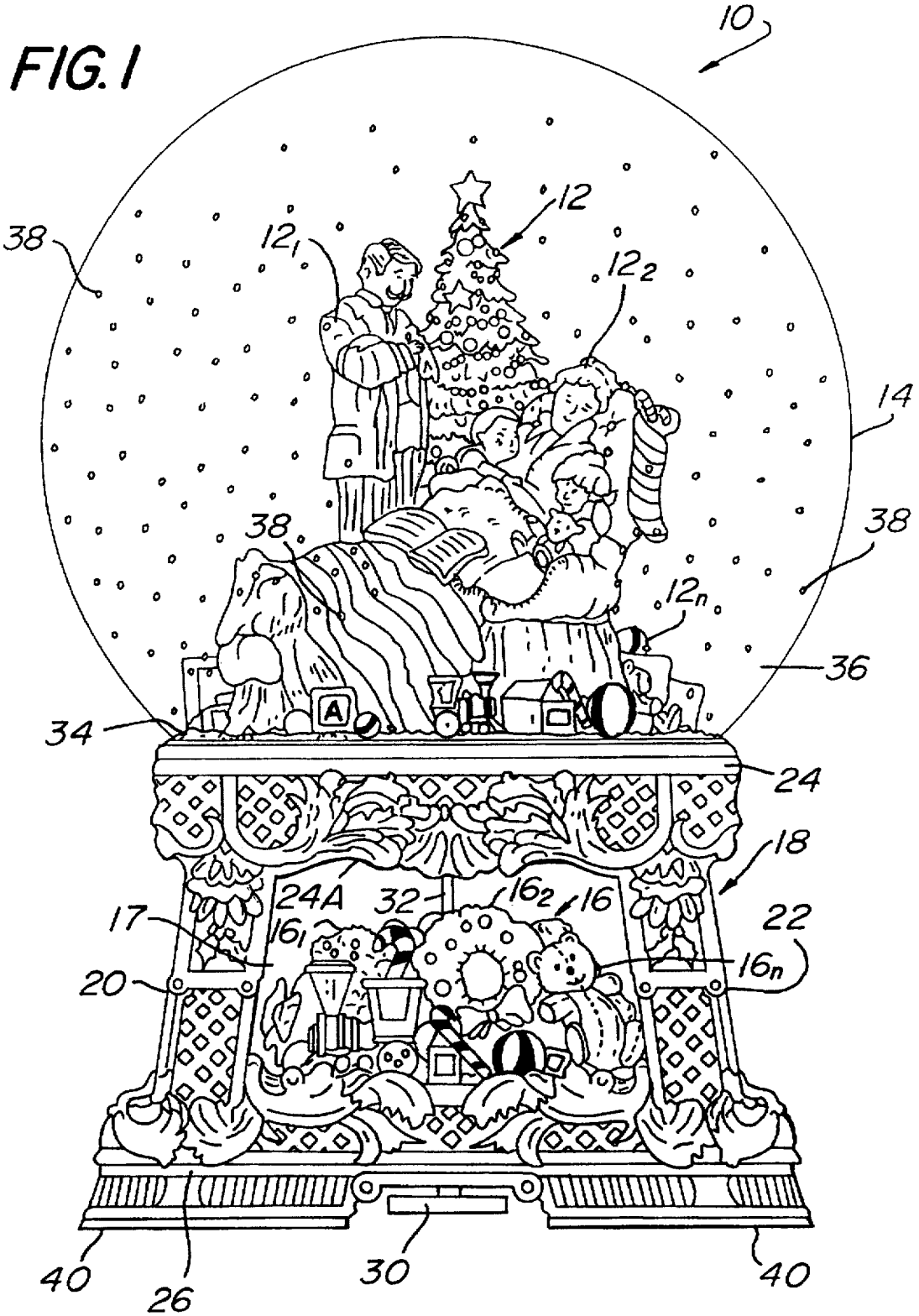
FIG. 1 is an elevational view of a selected side of the present invention.

Referring now to the drawings in detail, where like numerals refer to like parts or elements, there is shown in FIG. 1 an elevational view of a selected side of the decorative display device 10 of the present invention. The decorative display device 10 comprises a first scene 12 contained within a transparent enclosure 14, a second scene 16 exposed for direct viewing through a plurality of windows like window 17 in base 18. On either side of window 17 the base 18 comprises supports or columns 20, 22. An upper platform 24 and a lower platform 26 complete the base 18.

The decorative display device 10 further comprises a wind-up drive means 28 (See FIGS. 2 and 3) having a grippable knob 30 and a first output shaft 32 which may be interconnected to the scenes 12, 16 as will be described more completely hereinafter. Music is provided to the decorative display device 10 by way of a music producing means such as a music box 48 which is combined with and forms part of the wind-up drive means 28 as will be explained below.

The decorative display device 10 is preferably arranged so that the first and second scenes 12, 16, respectively, are placed one above the other to form a tier, thereby placing both scenes in the same field-of-view of an individual. Each of the upper and lower scenes 12 and 16, respectively, may be drivenly connected to the wind-up drive means 28 which causes a rotation so that each scene appears to be in synchronization with the music or melody produced by the music box 48. Rotating, music synchronized scenes are aesthetically pleasing, and thus, provide a more interesting display relative to known decorative display devices. The scenes 12, 16 may rotate simultaneously and synchronously (at the same speed in the same direction), or may rotate simultaneously and asynchronously (at different speeds in the same or opposite direction), or one scene may rotate (in either direction) while the other scene remains stationary, or both scenes may remain stationary.

The first scene 12, located on the upper tier of the decorative display device 10, comprises a plurality of figurines $12_1$, $12_2$ . . . $12_\eta$, each of which are preferably formed of a well-known polymeric (or similar) material and all of which are merged or blended into one integrated decorative scene, such as the family scene illustrated in FIG. 1 commonly associated with Christmas.

The enclosure 14 may be formed of glass or other suitable transparent material, such as plastic. The transparent enclosure 14 may be of any desired shape but preferably has the shape of a globe with a flat bottom portion on which a base 34 of scene 12 of the integrated figurines $12_1$, $12_2$ . . . $12_\eta$ is mounted. The transparent enclosure 14 is preferably sealed and is filled with an appropriate transparent liquid 36, such as water or an oil base liquid to achieve different aesthetic effects. The liquid 36 may have immersed therein small particles 38 of a selectable color, such as white, which simulates snow flowing or moving within the liquid, so that manual agitation of the decorative display device 10 causes a temporary suspension of the particles 38 in the liquid 36. When the decorative display device 10 is placed on a support surface, the particles 38 slowly settle onto the figurines $12_1$, $12_2$ . . . $12_\eta$, thereby simulating falling snow.

The second scene 16, located on the lower tier of the decorative display device 10, comprises a plurality of figurines $16_1$, $16_2$, . . . $16_\eta$, all preferably of a well-known polymeric (or similar) material and all merged into an integrated decorative scene, such as a pile of toys and holiday related items illustrated in FIG. 1 and commonly associated with a gift giving holiday such as Christmas. It is preferred that the designs of scenes 12, 16 be either complementary or contrasting relative to each other so as to enhance the noticeability and aesthetic effects imparted to a viewer thereof. Although scenes 12, 16 are both related to Christmas, it is to be recognized that other festive events may be depicted by the scenes 12, 16 in the practice of this invention.

The base 18 is preferably made of a metallic material and may have an ornamental design, as shown in FIG. 1, which provides for a blending aesthetic effect between the upper and lower scenes 12, 16 of the decorative display device 10. The base 18 has its lower platform 26 resting on legs 40 which serve a support function to provide support for the decorative display device 10. The lower platform 26 also serves a particular support function, which will be described with reference to FIG. 2.

The lower platform 26 has an circumferentially inwardly extending portion 26A to which the lower platform 26 is attached by means of fastening means such as screws 42. The lower platform 26 supports the wind-up drive means 28 which is attached by fastening means such as screws 44 to the lower platform 26. The drive means 28 also comprises an upwardly extending member 46 which supports a drum 47 (with outwardly extending prongs arranged in a predetermined array) on a first end, which drum 47 forms part of the music box 48. The music box 48 is connected (at a second end) to a gear box mechanism 50 by means of a gear 52. The gear box mechanism 50 may comprise a coil spring 98 (FIGS. 5 and 6) that is placed into tension by the rotation of the grippable knob 30. When the grippable knob 30 is relaxed, the coil spring unwinds and imparts a corresponding rotation to the output shaft 32 having a lower portion 32A surrounding an upper portion 32B.

In a first embodiment of the current invention the lower portion 32A of drive shaft 32 surrounds the upper portion 32B and is interconnected to a plate 54 which, in turn, is attached to the base of the second scene 16. This attachment may be effected in any known manner, such as by a thin layer of adhesive material 56. The second scene 16 also has a base 58 which is attached to the plate 54 and supports scene 16 in its predetermined position. The rotation of the plate 54 (through the connection of the plate 54 to the outer (lower) portion 32A of drive shaft 32) causes the rotation of the scene 16. The plate 54, in cooperation with the adhesive material 56, serves as the means for mechanical coupling and for interconnecting the scene 16 to the output shaft 32 of the wind-up drive means 28. The upper portion 32B of the output shaft 32 passes through the scene 16, preferably in a non-interfering manner, and exits vertically from the scene 16 by way of aperture 60.

Figure 2:
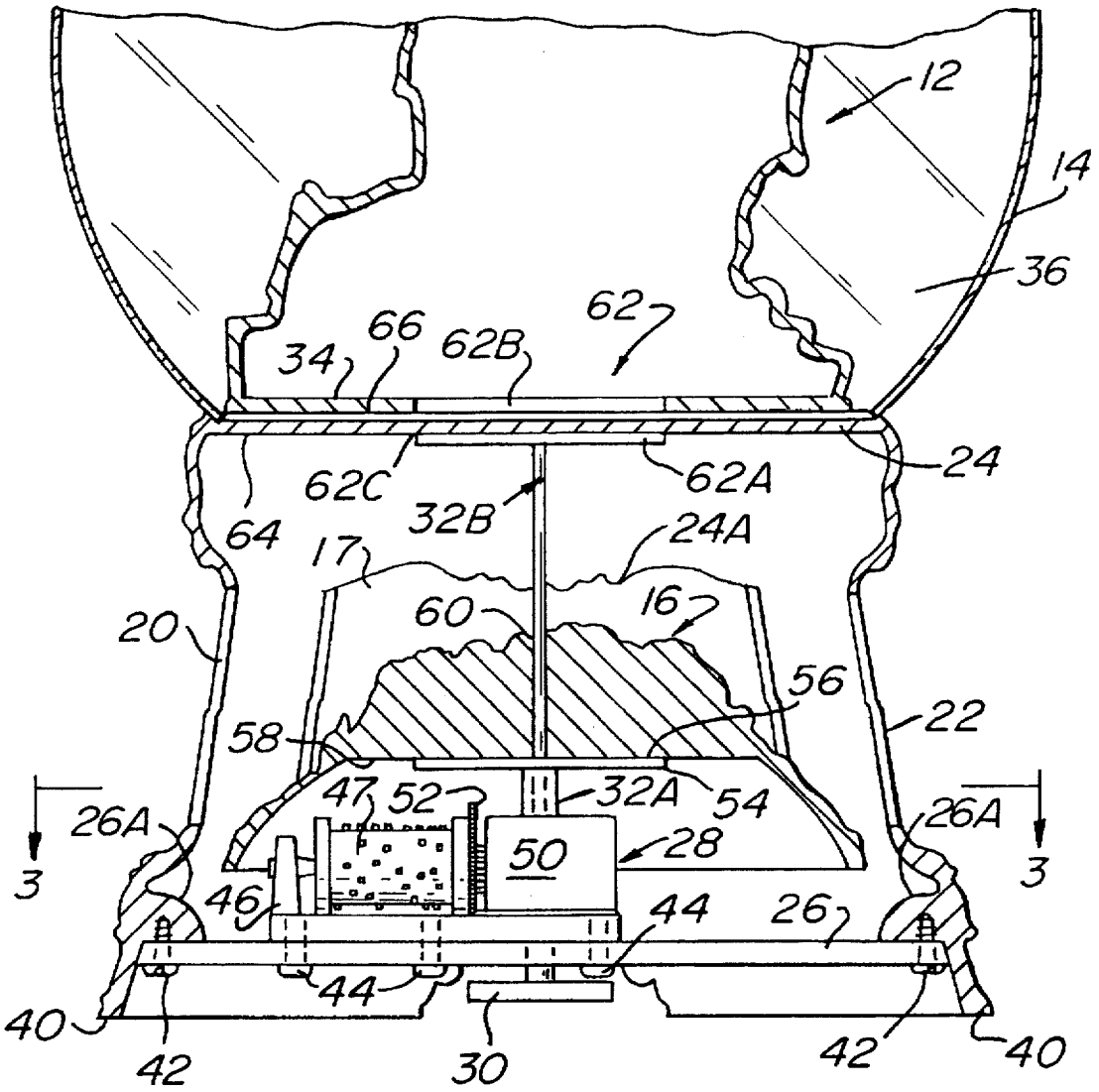
FIG. 2 is a partially broken-away view of the elevational view of FIG. 1 showing the positioning, arrangement, and interconnections of the first and second scenes and the wind-up drive means of the present invention.

The upper portion 32B of the output shaft 32 is connected to means 62 for magnetically coupling the base 34 of the scene 12 to the upper portion 32B of the output shaft 32, and to the wind-up drive means 28. The means 62 for magnetically coupling comprises a first plate 62A mechanically connected to the upward end of the upper portion 32B of the output shaft 32, a second plate 62B mechanically connected to the base 34 of the scene 12, and preferably seated within a downward facing recess in the base 34 as shown in FIG. 2. A mutual (magnetic) coupling path is created between the metallic (magnetized) plates 62A and 62B through the non-metallic platform 24 and a non-metallic base portion 64 of the transparent enclosure 14. The base portion 64 of the transparent enclosure 14 is physically separated from the base 34 of the scene 12 by a small gap 66 caused by the transparent liquid 36 to permit rotational movement of the scene 12 within the enclosure 14. Such movement is provided by the fluid 36 within the enclosure 14 which substantially eliminates the coefficient of friction between the base 34 of scene 12 and the base portion 64 of the enclosure 14.

The fluid 36 may be inserted into the enclosure 14 by way of an aperture (not shown) in the base portion 64 which is then sealed so that the fluid 36 remains within the sealed enclosure 14 without opportunity to evaporate or leak from the enclosure. The scene 12 within the sealed enclosure 14 is rotated because of the magnetic coupling means 62 although the base 34 of the scene 12 is not mechanically connected to the output shaft 32.

Figure 3:
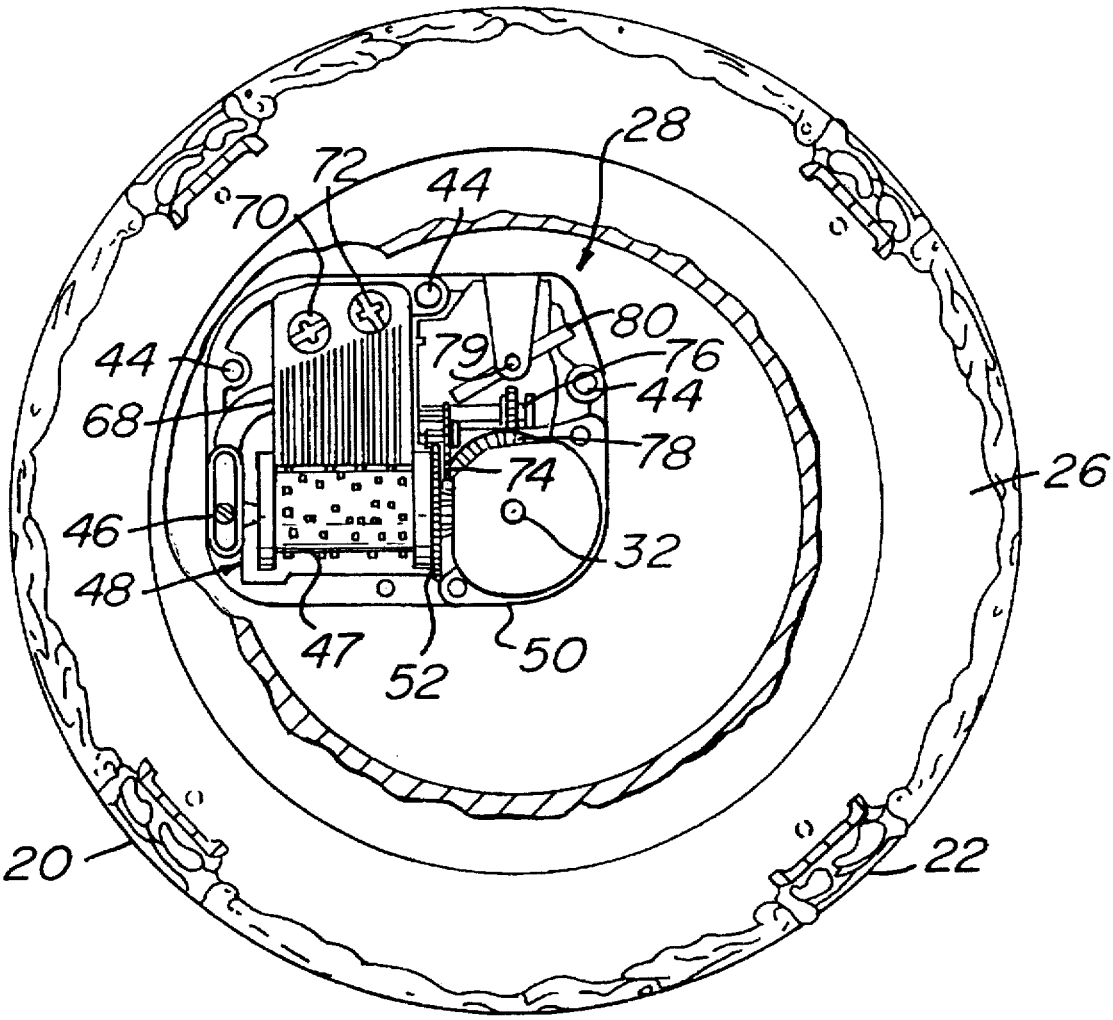
FIG. 3 is a sectional view of the invention, taken along line 3—3 of FIG. 2, illustrating further details of the combination wind-up drive means and music box of the present invention.

The wind-up drive means 28 provides the rotational momentum for such revolving motion and will be described with particular reference to FIG. 3. FIG. 3 illustrates the wind-up drive means 28 as comprising a musical tine member 68 which contacts the pronged drum 47 and is preferably connected to the wind-up drive means 28 by way of screw members 70 and 72. The wind-up drive means 28 further comprises intermeshing gears 52, 74, 76, 78 all of which mesh, so that the gear box mechanism 50 provides the impetus for moving the output shaft 32 of drive means 28. Intermeshing gears 52, 74, 76 and 78 are connected to the music box 40 and a dissipation assembly comprising a fly-wheel 80 and a standing helical gear 79 which serve to slow the rotation of the shaft 32. The output shaft 32 is positioned at the center of the decorative display device 10 so that the length of the shaft 32 extends along the vertical central axis of the display device 10.

The pronged drum 47, in cooperation with the tine element 68, provides a melody sounding device (music box 48) which allows for the wind-up drive means 28 to serve as a built-in source of music to accompany the revolving motion of scenes 12 and 16. The drum 47 and the tine element 68 may be appropriately selected so as to provide various melodies, for example, a Christmas melody, to enhance the aesthetic effects of the rotating scenes 12, 16. Moreover, since the drum 47 and the musical tine element 68 are interconnected and activated by the gear box mechanism 50, which can also activate the revolving motion of scenes 12, 16, the revolving scenes 12 and 16 give the appearance to a viewer that the scenes 12, 16 are in synchronization with the melody being played by the combination of the drum 47 and the musical tine element 68.

Figure 4:
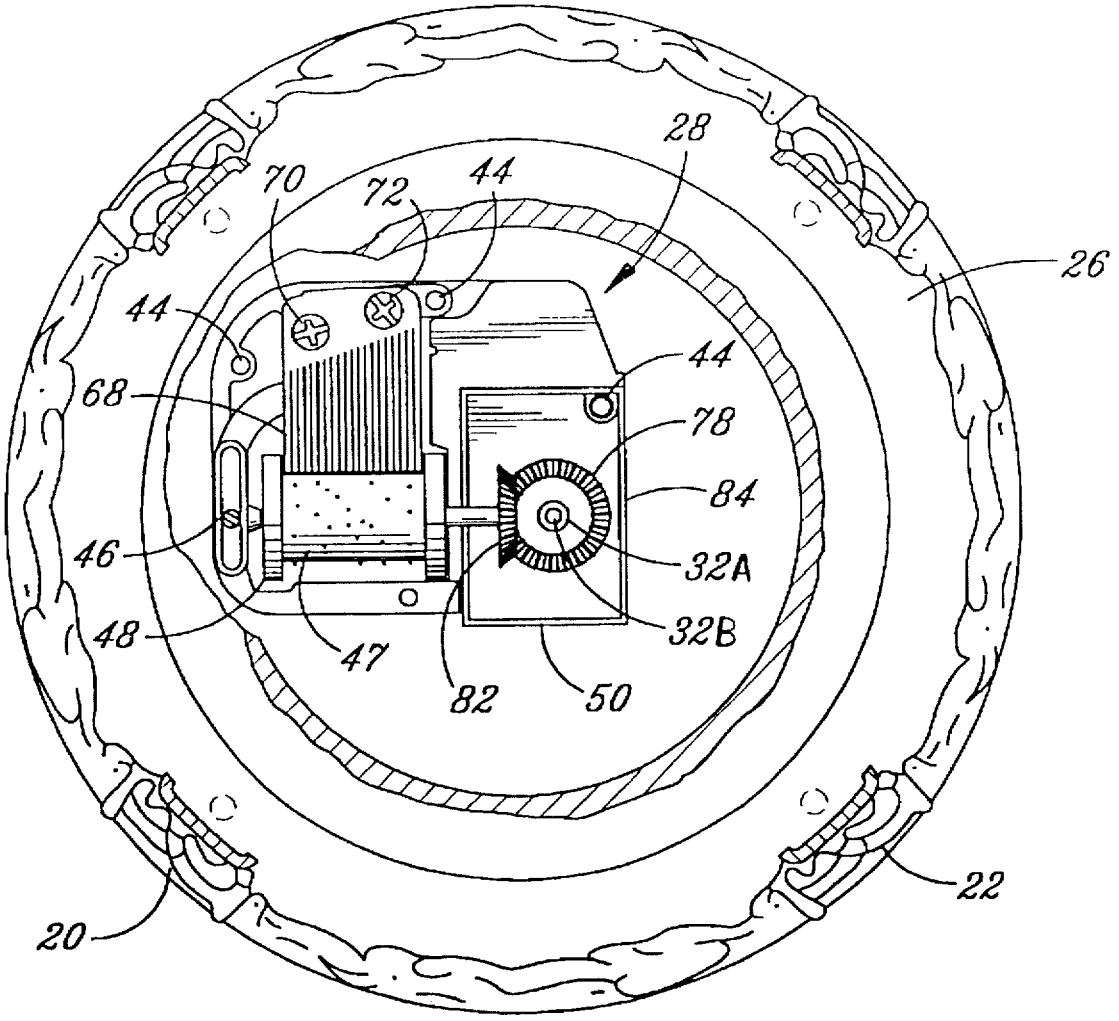
FIG. 4 is an elevational view of a second embodiment of the present invention showing one possible gear assembly allowing first and second scenes to rotate in the same direction at the same speed.
Figure 5:
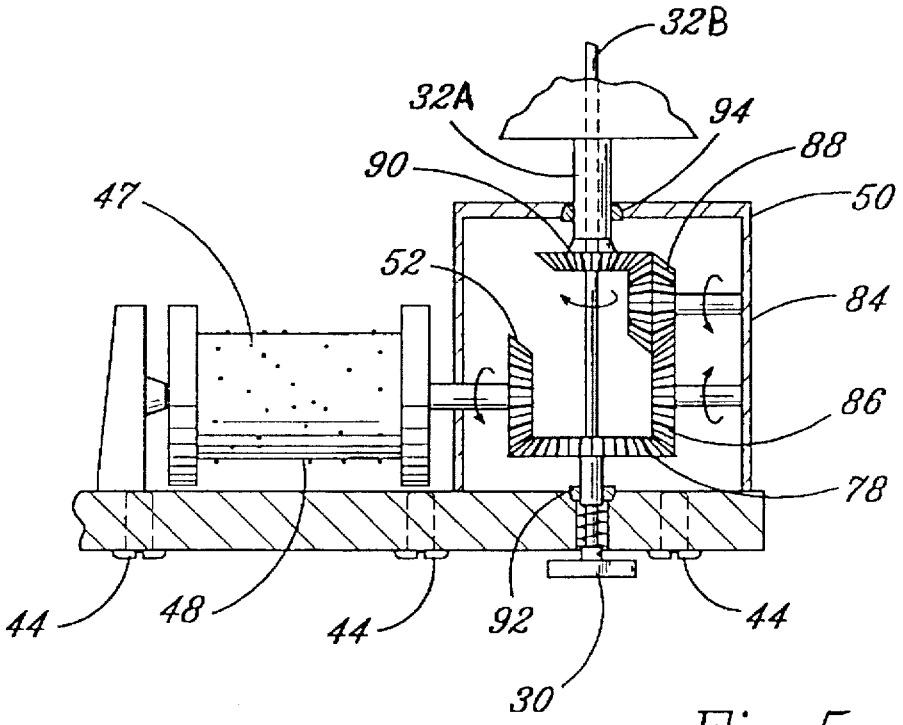
FIG. 5 is a sectional side view of a second embodiment of the present invention showing one possible gear assembly allowing first and second scenes to rotate in the same direction, but at different speeds.

As previously discussed the scenes 12, 16 may revolve or remain stationary with respect to each other. One embodiment of the present invention features the first scene 12 not connected to the output shaft 32, but instead, is anchored firmly upon the upper platform 24 by means of an adhesive or other mounting means. Similarly, in another embodiment of the present invention, the first scene is connected to the output shaft 32, but the second scene 16 is anchored firmly upon the lower platform 26 in a similar manner. In these embodiments of the decorative display device 10 of the present invention rotational motion is imparted to only the lower tier, i.e. the second scene 16, while the upper tier, i.e. the first scene 12 remains stationary. Likewise, when the lower tier is fixed, the upper tier rotates. Such rotational motion may be in either direction, but only in one direction. In a second embodiment of the present invention, as illustrated in FIG. 4 the scenes 12, 16 of the decorative display device 10 may be rotated in the same direction and at the same speed. This is afforded by a coupling of the shaft segment 32A and the shaft segment 32B in the gear box 50 so that both shaft segments 32A, 32B rotate in the same direction at the same speed. Since the shaft segments 32A, 32B are arranged concentrically one about the other such coupling is easily accomplished by connecting the shaft segments 32A, 32B to the same gear or drive member. An alternate embodiment as illustrated in FIG. 5, can impart different rotational speeds to each of the scenes 12, 16 by varying the diameter of the drive or gear to which the shaft segments 32A and 32B are connected within the gear box 50. The speeds will be proportional to the difference in the dimensional relationship of the respective gears or drive diameters.

FIG. 5 illustrates one option for gear box 50 which accomplishes the above mentioned rotation. The gears within gear box 50 are configured to represent a speed altering means. The knob 30, when rotated, winds or tightens the coil spring 98. As the coil spring 98 unwinds it imparts rotational energy to bevel gear 78 which actuates the music box 48 and imparts rotational energy through bevel gear 86 and double bevel gear 88 which, in turn, imparts motion to bevel gear 90. Bevel gear 90 is smaller in diameter than gear 78 which creates a different rotational velocity. Bevel gears 78, 86, 88 and 90 are mounted to the gear box frame 84 as described more fully below. Mounted directly to gear 78 is the upper drive shaft 32B which runs through the center of bevel gear 90. Lower drive shaft 32A is attached directly to the upper surface of bevel gear 90 and is hollow to allow for upper shaft 32B to pass through along its central axis.

Bevel gear 90 is seated in gear box frame 84 at its upper end. The upper end of bevel gear 90 is bent in an arc-like fashion to form a rotatable connector 94. The rotatable connector 94 forms a cavity between the gear box frame 84 and the rotatable connector. Within this cavity is a lubricant 96A which will allow the upper end of bevel gear 90 to rotate upon the gear box frame 84. The lubricant 96A can be liquid or mechanical such as a micro-ball bearing system.

Figure 6:
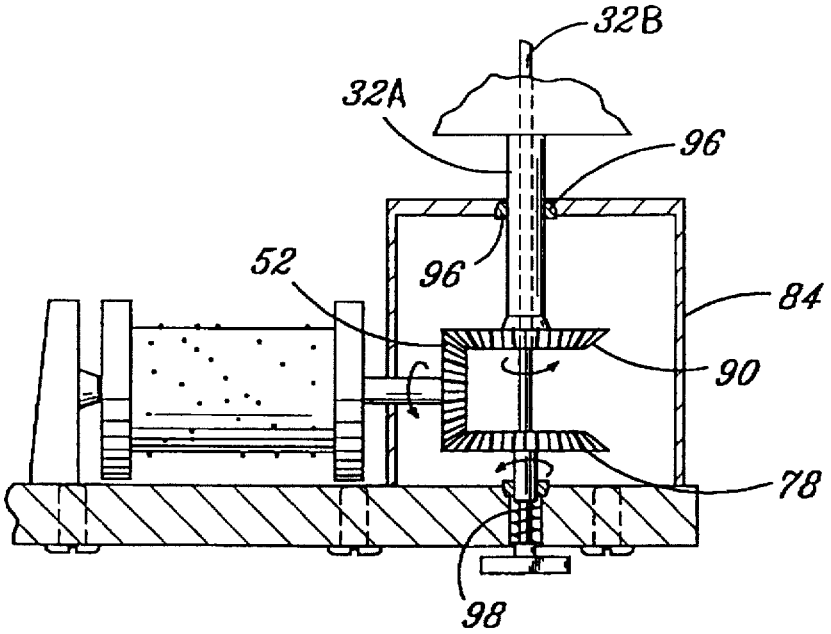
FIG. 6 is a sectional view of a third embodiment of the present invention showing another possible gear assembly allowing first and second scenes to rotate in different directions.

A third embodiment of the decorative display device of the present invention imparts rotational motion that causes the scenes 12, 16 to be revolved in different directions and at the same or different speeds. Opposite direction rotational motion can be accomplished by connecting the shaft segments 32A and 32B to different gears or drives which rotate within the gear box 50 in different and opposing directions. The present invention also provides a gear box configuration which serves as a means for imparting motion in a first and second direction to the upper and lower scenes. FIG. 6 illustrates one gear box 50 option which will allow for rotation of the upper 12 and lower 16 scenes in the opposite direction at the same speed. In FIG. 6 coil spring 98 is again connected to the lower surface of bevel gear 78 which imparts rotational energy to bevel gear 52 which actuates music box 48. Bevel gear 52 also imparts rotational energy to bevel gear 90. The result of this gear configuration is that upper scene 12 will rotate at nearly the same speed, exact matching speeds being impossible due to mechanical losses, but in the opposite direction. As in the second embodiment of the present invention, the upper surface of bevel gear 90 is connected to the gear box frame 84 by means of the rotatable connector 94 described above. If the gears or drives are sized identically, then the speed which is imparted to the respective shaft segments 32A, 32B is the same. The upper and lower scenes 12 and 16 can have opposite motion at different speeds. It is clear from the drawings that the addition of one more gear can be used to vary the speed of one of the scenes based on diameters and inevitable mechanical losses. If the gears or drives have dissimilar diameters, then the speed which will be imparted to the shaft segments 32A, 32B will be different and in proportion to the dimensional relationship of the respective gear or drive diameters.

A fourth, which has been partially described above and is illustrated in FIG. 7, embodiment imparts rotational motion to only the upper tier, i.e. the first scene 12, of the decorative display device 10 with the lower tier, i.e. the second scene 16, remaining stationary. In this embodiment the shaft segment 32B is connected to a drive or gear within gear box 50 and the shaft segment 32A is mounted to the case of the gear box 50 and remains static. In all of the recited embodiments where rotational motion is imparted to either or both scenes 12, 16, the motion is accompanied by the playing of the music box mechanism 48 so that the motion of the scenes 12, 16 is viewed while hearing the tones generated by the music box mechanism 48.

In operation, the revolving of the first scene 12 and second scene 16 is initiated by the rotational winding of the grippable knob 30 which, in turn, causes the coil spring (not shown) of the gear box mechanism 50 to be placed into tension. When the grippable knob 30 is relaxed, the coil spring unwinds and imparts rotation to the output shaft 32 (either or both shaft segments 32A, 32B) which, in turn, imparts a corresponding rotational motion to either or both the plate 54 and the magnetic coupling means 62. For the embodiments of the decorative display device 10 of the present invention the rotation of scenes 12 and 16 provide for a noticeable and aesthetic effect to a viewer. Further, the upper tier scene 12 and the lower tier scene 16, positioned at different vertical levels, are both within the same field-of-view and, thus, further attract the attention of a viewer, so as to further enhance the aesthetic effect provided by the decorative display device 10 of FIGS. 1–3.

It should now be appreciated that the practice of the present invention provides for a decorative display device 10 that has tiered scenes which can have rotational motion imparted to one or both scenes, with variable rotational speed and direction, to enhance the noticeability and an aesthetic effect of the present invention as compared to prior decorative display devices.

The present invention may be embodied in other specific forms without departing from the spirit or essential attributes thereof and, accordingly, the described embodiments are to be considered in all respects as being illustrative and not restrictive, with the scope of the invention being indicated by the appended claims, rather than the foregoing detailed description, as indicating the scope of the invention as well as all modifications which may fall within a range of equivalency which are also intended to be embraced therein.

I claim:

1. A decorative display device comprising;

(a) a first scene having a base and comprising figurines contained within a transparent enclosure;

(b) a second scene having a base and comprising figurines with said second scene being located directly below said first scene;

(c) a base comprising supports and an upper and a lower platform upon which said first and second scenes are positioned with said second scene being located within said base at a predetermined vertical spacing from said first scene creating tiered scenes;

(d) drive means having at least one output shaft which is capable of rotational motion and a gear box which is connected to and rotates said at least one output shaft;

(e) means for mechanically coupling the base of said second scene to said output shaft so that rotational motion may be imparted to said second scene causing the second scene to revolve while the first scene remains stationary.

2. The decorative display device according to claim 1, wherein said transparent enclosure is sealed and further contains a transparent liquid having particles immersed therein.

3. The decorative display device according to claim 1, wherein said drive means further comprises music producing means interconnected to said output shaft for producing music simultaneously with said imparted rotational motion.

4. A decorative display device comprising;

(a) a first scene having a base and comprising figurines contained within a transparent enclosure;

(b) a second scene having a base and comprising figurines with said second scene being located directly below said first scene;

(c) a base comprising supports and an upper and a lower platform upon which said first and second scenes are positioned with said second scene being located within said base at a predetermined vertical spacing from said first scene creating tiered scenes;

(d) drive means having at least one output shaft which is capable of rotational motion and a gear box which is connected to and rotates said at least one output shaft;

(e) means for magnetically coupling the base of said first scene to said output shaft so that rotational motion may be imparted to said first scene causing the second scene to revolve while the first scene remains stationary.

5. The decorative display device according to claim 4, wherein said transparent enclosure is sealed and further contains a transparent liquid having particles immersed therein.

6. The decorative display device according to claim 4, wherein said drive means further comprises music producing means interconnected to said output shaft for producing music simultaneously with said imparted rotational motion.

7. A decorative display device comprising;

(a) a first scene having a base and comprising figurines contained within a transparent enclosure;

(b) a second scene having a base and comprising figurines located directly below said first scene;

(c) a base comprising supports and an upper and lower platform upon which said first and second scenes are positioned at a predetermined vertical spacing creating tiered scenes;

(d) drive means having at least one output shaft which is capable of rotational motion and a gear box which is connected to, and rotates, said at least one output shaft;

(e) means for magnetically coupling the base of said first scene to a first segment of said output shaft and magnetically coupling the base of said second scene to a second segment of said output shaft; and, (f) means for imparting rotational motion in a first direction to a first segment of said output shaft and for imparting rotational motion in a second direction to said second segment of said output shaft.

8. The decorative display device according to claim 7, wherein said gear box of said drive means further comprises a speed altering means so that said first scene revolves at a speed which is different from said second scene.

9. The decorative display device according to claim 7, wherein said first and second directions are the same direction.

10. The decorative display device according to claim 9, wherein said gear box of said drive means is configured to further comprise a speed altering means so that said first scene revolves at a speed which is different from said second scene.

11. The decorative display device according to claim 10, wherein said transparent enclosure is sealed and further contains a transparent liquid having particles immersed therein.

12. The decorative display device according to claim 11, wherein said wind-up drive means further comprises sound producing means interconnected to said output shaft for producing sound simultaneously with said imparted rotational motion.

13. The decorative display device according to claim 7, wherein said first and second directions are opposite directions.

14. The decorative display device according to claim 13, wherein said gear box of said drive means is configured to comprise a speed altering means so that said first scene revolves at a speed which is different from said second scene.

15. The decorative display device according to claim 14, wherein said transparent enclosure is sealed and further contains a transparent liquid having particles immersed therein.

16. The decorative display device according to claim 15, wherein said wind-up drive means further comprises sound producing means interconnected to said output shaft for producing sound simultaneously with said imparted rotational motion.

17. The decorative display device according to claim 7, wherein said transparent enclosure is sealed and further contains a transparent liquid having particles immersed therein.

18. The decorative display device according to claim 7, wherein said wind-up drive means further comprises sound producing means interconnected to said output shaft for producing sound simultaneously with said imparted rotational motion.

* * * * *

US005705759C1

(12) EX PARTE REEXAMINATION CERTIFICATE (5273rd)

United States Patent

DeVivo

(10) Number: US 5,705,759 C1

(45) Certificate Issued: Feb. 21, 2006

(54) TWO-TIERED MUSIC BOX WITH REVOLVING FIGURINES

(75) Inventor: Douglas E. DeVivo, Taipei (TW)

(73) Assignee: Mercuries & Associates (USA), Ltd., Bethlehem, PA (US)

Reexamination Request:
No. 90/005,565, Nov. 17, 1999

Reexamination Certificate for:

| | |
|---|---|
| Patent No.: | **5,705,759** |
| Issued: | **Jan. 6, 1998** |
| Appl. No.: | **08/802,823** |
| Filed: | **Feb. 19, 1997** |

Related U.S. Application Data

(63) Continuation-in-part of application No. 08/376,036, filed on Jan. 20, 1995, now abandoned.

(51) Int. Cl.
*G10F 1/06* (2006.01)

(52) U.S. Cl. ..... 84/95.2; 446/298; 17/20; 40/410; 40/505; 40/503

(58) Field of Classification Search ..... 84/94.1, 84/94.2, 95.1, 95.2; 40/455, 457, 409, 410, 40/493, 503–505; 446/297, 298, 265, 303; 17/24

See application file for complete search history.

(56) References Cited

U.S. PATENT DOCUMENTS

| | | | |
|---|---|---|---|
| D24,965 | S | 12/1895 | Ehrlich |
| 1,348,386 | A | 8/1920 | Wronowski |
| 3,349,661 | A | 10/1967 | Searls |
| 3,594,934 | A | 7/1971 | Burnbaum |
| 4,196,899 | A | 4/1980 | Patterson |
| 4,203,241 | A | 5/1980 | Wallace |
| 4,344,243 | A | 8/1982 | Reszka |
| 4,458,573 | A | 7/1984 | Isaka |
| 4,490,931 | A | 1/1985 | Fleemin |
| 4,521,982 | A | 6/1985 | Altuchow |
| 4,573,939 | A | 3/1986 | Hoshino |
| 4,618,330 | A | 10/1986 | Abe |
| D286,796 | S | 11/1986 | Simmons |
| 4,641,445 | A | 2/1987 | Rossi |
| 4,771,902 | A | 9/1988 | Teng |
| 4,817,311 | A | 4/1989 | Ong S. T. |
| 4,852,283 | A | 8/1989 | Teng |
| 4,858,079 | A | 8/1989 | Ohashi |
| 4,961,276 | A | 10/1990 | Lin |
| 4,983,890 | A | 1/1991 | Satoh et al. |
| 5,070,633 | A | 12/1991 | Liu |
| 5,088,218 | A | 2/1992 | Liu |
| 5,090,144 | A | 2/1992 | Liu |
| 5,092,065 | A | 3/1992 | Teng |
| 5,110,636 | A | 5/1992 | Hou |
| 5,131,175 | A | 7/1992 | Liu ..... 40/410 |
| 5,134,795 | A | 8/1992 | Wang |
| 5,179,796 | A | 1/1993 | Gephart, Jr. |

(Continued)

FOREIGN PATENT DOCUMENTS

| | | |
|---|---|---|
| BE | 562834 | 5/1958 |
| IT | 604908 | 5/1960 |

OTHER PUBLICATIONS

The San Francisco Music Box Company Catalog, Nov. 2, 1991, pp. 32 and 34.

Collectors' Information Bureau's Collectibles Market Guide & Price Index, 1994, p. 16.

*Primary Examiner*—Jeffrey Donels

(57) ABSTRACT

A decorative display device comprising figurines arranged in tiered first and second scenes, one scene being placed above the other. Each of the upper and lower tier scenes is coupled to a wind-up drive and music box mechanism and when rotated appears to be in sychronization with the music. The rotatable and music synchronized scenes are more noticeable and aesthetically pleasing and, thus, provide a more interesting display. The upper and lower tier scenes may rotate simultaneously, at different speeds (but in the same direction), in opposite directions, in opposite directions at different speeds, or one scene may rotate while the other scene remains stationary.

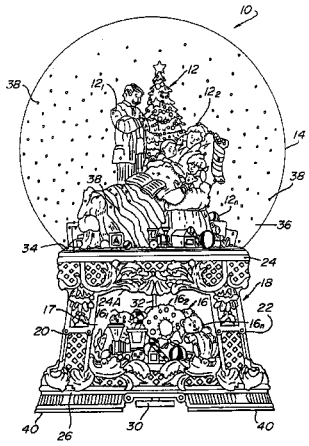

U.S. PATENT DOCUMENTS 5,189,821 A 3/1993 Lee
5,221,225 A 6/1993 Newbolt et al.
5,226,845 A 7/1993 Wu
5,286,535 A 2/1994 Hou
5,313,727 A 5/1994 Murray, Jr.
5,338,583 A 8/1994 Hou
5,396,723 A 3/1995 Liu
5,416,995 A 5/1995 Teng
5,442,869 A 8/1995 McDarren et al.
5,456,031 A 10/1995 Hou
5,458,012 A 10/1995 Liu
5,483,763 A 1/1996 Liu
5,491,916 A 2/1996 Ingram et al.
5,502,908 A 4/1996 Powell et al.
5,532,422 A 7/1996 Chang
5,548,912 A 8/1996 Liu
5,555,656 A 9/1996 Liu ..... 40/411
5,609,341 A 3/1997 Chuang
5,620,353 A 4/1997 Lai
5,655,321 A 8/1997 Chang
5,675,921 A 10/1997 Lin ..... 40/409

EX PARTE REEXAMINATION CERTIFICATE ISSUED UNDER 35 U.S.C. 307

NO AMENDMENTS HAVE BEEN MADE TO THE PATENT

AS A RESULT OF REEXAMINATION, IT HAS BEEN DETERMINED THAT:

The patentability of claims 1–18 is confirmed.

* * * * *